US005315791A

United States Patent [19]

Iwai et al.

[11] Patent Number: 5,315,791

[45] Date of Patent: May 31, 1994

[54] STEEL BALL MACHINING APPARATUS CAPABLE OF ELIMINATING FOREIGN MATTER

[75] Inventors: Tatsuo Iwai; Isao Fujiwara, both of Nara, Japan

[73] Assignee: Tsubakimoto Precision Products Co., Ltd., Osaka, Japan

[21] Appl. No.: 899,542

[22] Filed: Jun. 16, 1992

[30] Foreign Application Priority Data

Jun. 18, 1991 [JP] Japan ..... 3-171852

[51] Int. Cl.[5] ..... B24B 11/04

[52] U.S. Cl. ..... 51/215 M; 51/215 HM; 51/111 R; 51/289 S

[58] Field of Search ..... 51/111 R, 117, 130, 51/317, 318, 289 S, 215 M, 215 HM, 215 UE

[56] References Cited

U.S. PATENT DOCUMENTS

| | | | |
|---|---|---|---|
| 967,918 | 8/1910 | Hirth | 51/130 |
| 1,252,364 | 1/1918 | Schaum | 51/130 |
| 1,772,365 | 8/1930 | Pratt | 51/130 |
| 1,898,979 | 2/1933 | Matteson | 51/130 |
| 1,921,686 | 8/1933 | Matteson | 51/130 |
| 1,973,922 | 9/1934 | Dumas | 51/130 |
| 2,764,851 | 10/1956 | Dieterichs | 51/130 |
| 3,348,338 | 10/1967 | Messerschmidt | 51/130 |

*Primary Examiner*—Jack Lavinder
*Attorney, Agent, or Firm*—Howson & Howson

[57] ABSTRACT

A steel ball machining apparatus comprises a ball machining mechanism having a pair of machining plates which are adapted to oppose and rotate relative to each other, a steel ball storing vessel for supplying to and receiving from said polishing mechanism steel balls, a steel ball supply path provided between said machining mechanism and said steel ball storing vessel, a steel ball discharge path provided between said machining mechanism and said steel ball storing vessel adapted to discharge said steel balls to said vessel, and a set of parallel bars provided in at least one of said steel supply path and steel ball discharge path so as to eliminate foreign matter.

2 Claims, 7 Drawing Sheets

STEEL BALL MACHINING APPARATUS CAPABLE OF ELIMINATING FOREIGN MATTER

FIELD OF INVENTION

The present invention relates to a steel ball machining apparatus used in flashing, grinding, and lapping processes in the manufacturing of steel balls.

BACKGROUND OF INVENTION

Steel balls used in ball bearings, etc., are first made from wire materials into roughly spherical blanks having flashes. Then, they are subjected to flashing process to remove such flashes, heat treatment to impart the required strength and durability to the balls, grinding process thereafter, and lapping process to finish the balls with high accuracy after the grinding process.

FIG. 7 illustrates a steel ball machining apparatus 70 of prior art used in the above-mentioned flashing, grinding, and lapping processes. The apparatus 70 comprises a machining mechanism 76 having a rotary plate 72 and a stationary plate 74, and a conveyor 80 having a vessel 82 for supplying steel balls 78 between the rotary plate 72 and the stationary plate 74 and receiving steel balls 78 therefrom. The conveyor may be either a rotor conveyor type, a water propeller type or a bucket elevator type. In the flashing process, the rotary plate 72 and the stationary plate 74 have the respective ball grooves (not shown); and are axially pressed together with the balls held therebetween. In the grinding and lapping processes, balls are fed between the rotary plate 72 and the stationary plate 74 with a grinding fluid, the surface plate 74 having V- or R-shaped grooves and the rotary plate 72 having ball grooves with a predetermined depth.

The steel balls 78 supplied by the conveyor 80 are held between the rotary plate 72 and the stationary plate 74 and processed while rolling along the grooves. After making almost a round held between the rotary plate 72 and the stationary plate 74, the balls 78 are discharged to the conveyor 80. The balls 78 circulate through the machining mechanism 76 and the conveyor 80 until the predetermined dimensional accuracy is attained.

The flashing process is mainly to remove flashes. Most of the flashes will fall from the space between the rotary plate 72 and the stationary plate 74 along with the grinding fluid. However, some of them in fact are returned to the conveyor 80 and are fed into the machining mechanism 76. Consequently, it is possible that the flashes will damage the ball grooves of the rotary plate 72 and the stationary plate 74. In addition, it is also possible that wire materials which failed proper machining during the initial forming process are mixed with the balls and fed to the machining mechanism 76 damaging the grooves of the rotary plate 72 and the stationary plate 74.

In the grinding and lapping processes, a grinding wheel is utilized as the rotary plate 72. When steel balls 78 are fed to the machining mechanism 76, the grinding wheel oftentimes breaks off. Such chips of a grinding wheel will also fall from the space between the rotary plate 72 and the stationary plate 74 along with the grinding fluid. But, some of them are accidentally fed by the conveyor 80 to the machining mechanism 76 damaging the ball grooves of the rotary plate 72 and the stationary plate 74. Furthermore, in case balls having flaws or cracks are fed into the machining mechanism 76, they will also give rise to the possibility of a similar damage.

Thus, the object of the present invention is in the first place to provide a steel ball machining apparatus which is capable of removing foreign matter which are apt to accidentally mix with the processed steel balls.

Secondly, the object of the present invention is to provide a steel ball machining apparatus which is capable of protecting the ball grooves in the rotary plate and the stationary plate by eliminating foreign matter.

A further object of the present invention is to provide a steel ball machining apparatus which is capable of guaranteeing a predetermined level of quality of the finished steel balls by protecting the ball grooves of the machining plates as mentioned above.

SUMMARY OF INVENTION

The present invention has solved the above-mentioned problems by a steel ball machining apparatus comprising:

- a machining mechanism having a pair of machining plates which are adapted to oppose and rotate relative to each other;
- a steel ball storing vessel for supplying to and receiving from said machining mechanism steel balls;
- a steel ball supply path provided between said machining mechanism and steel storing ball vessel;
- a steel ball discharge path provided between said machining mechanism and steel ball storing vessel adapted to discharge said steel balls to said vessel; and
- a set of parallel bars provided to at least one of said steel ball supply path and steel ball discharge path.

Steel balls are fed to the machining mechanism from the storing vessel through the supply path. The steel balls make almost a round held between the pair of the machining plates. Then, the balls are returned to the vessel through the discharge path. Until the predetermined dimensional accuracy is attained, the steel balls circulate through the vessel and the machining mechanism.

The set of parallel bars provided in the supply path and/or discharge path will let pass downwardly the flashes, wire materials. and defective balls which are smaller than the gaps between the adjacent bars, before the balls are fed to the machining mechanism or after the balls are discharged from the machining mechanism.

EMBODIMENTS

The following embodiment will be described with reference to a flashing process. The polishing apparatus used in grinding and lapping processes is almost the same and will be referred to later.

Figure 5:
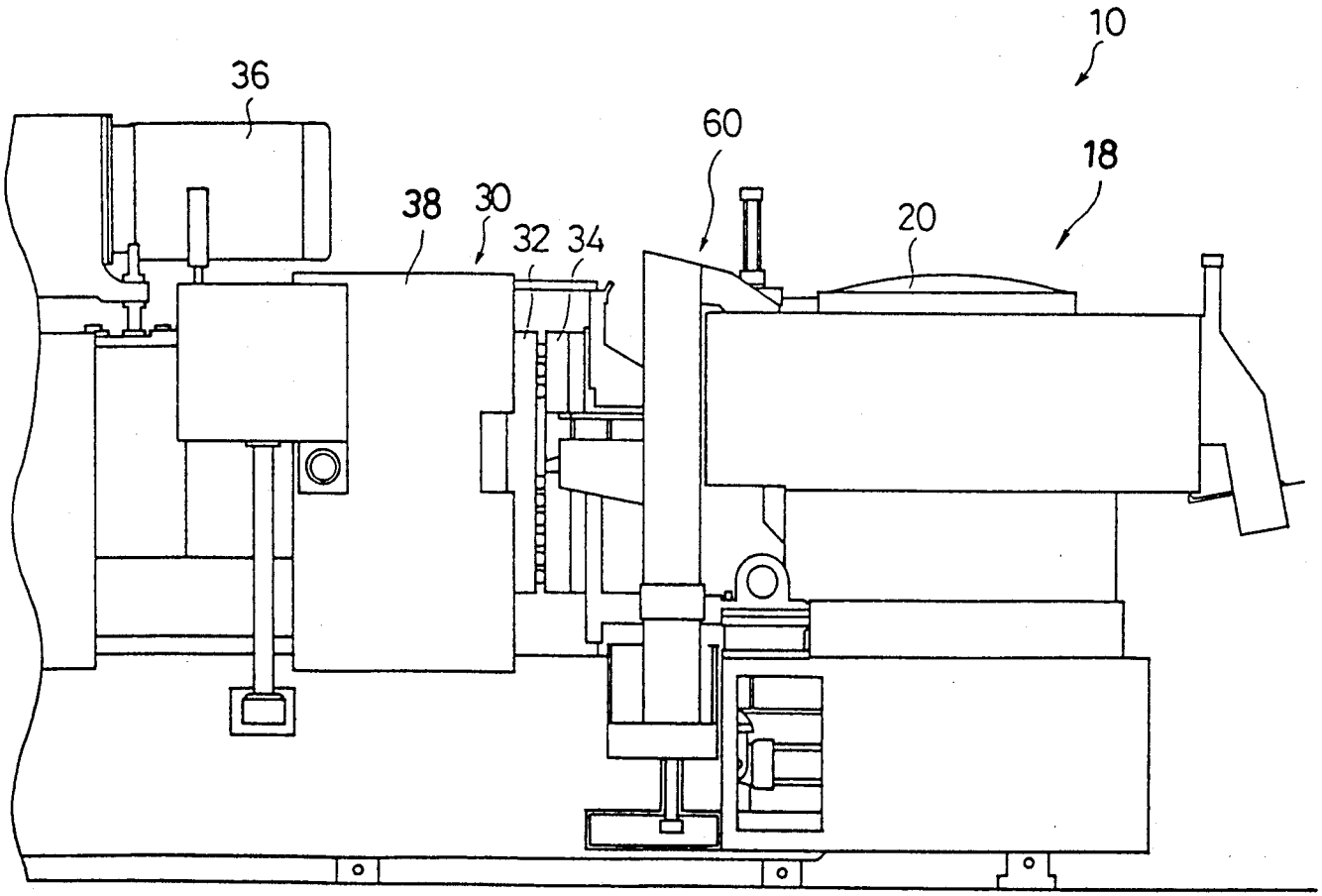
FIG. 5 is an overall front view of the apparatus shown in FIG. 1.
Figure 6:
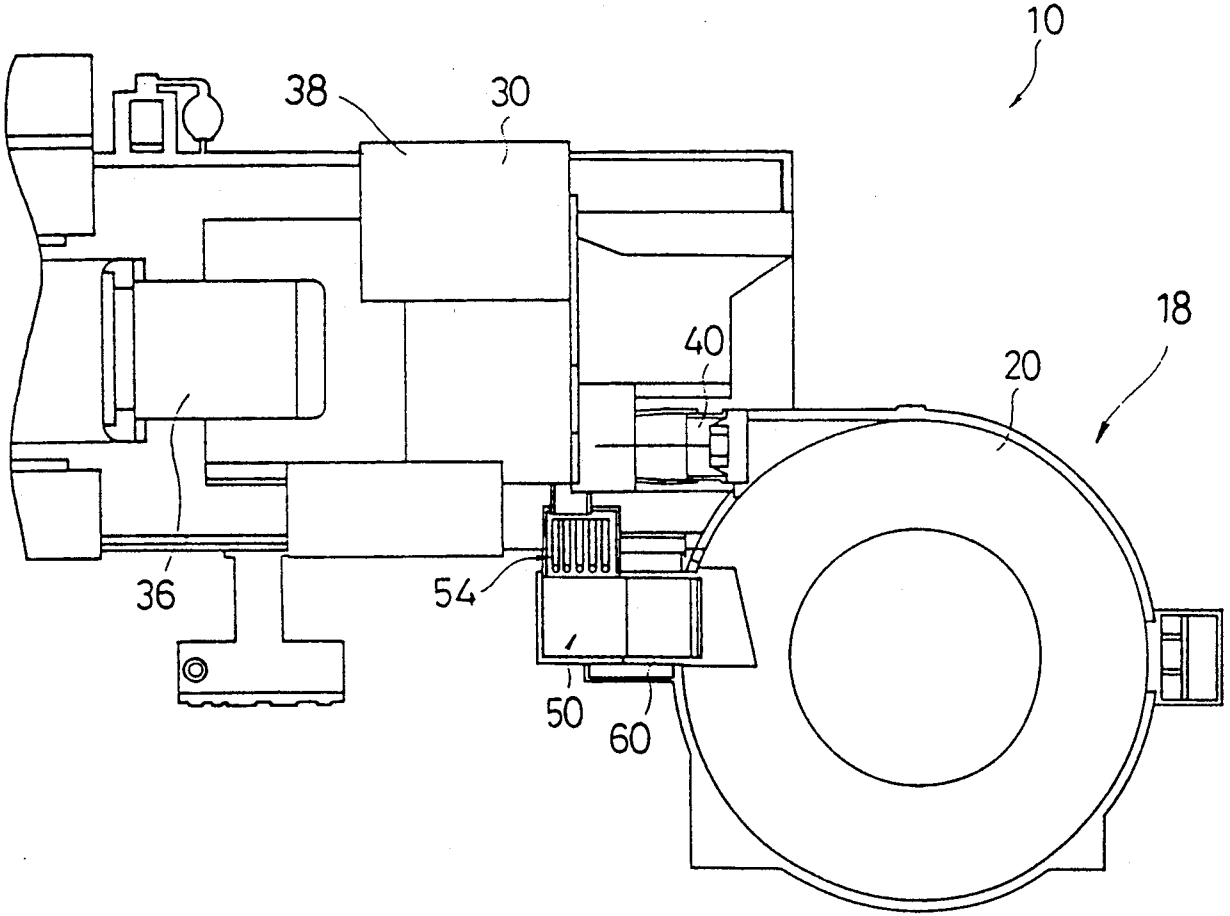
FIG. 6 is a top view of FIG. 5.
Figure 7:
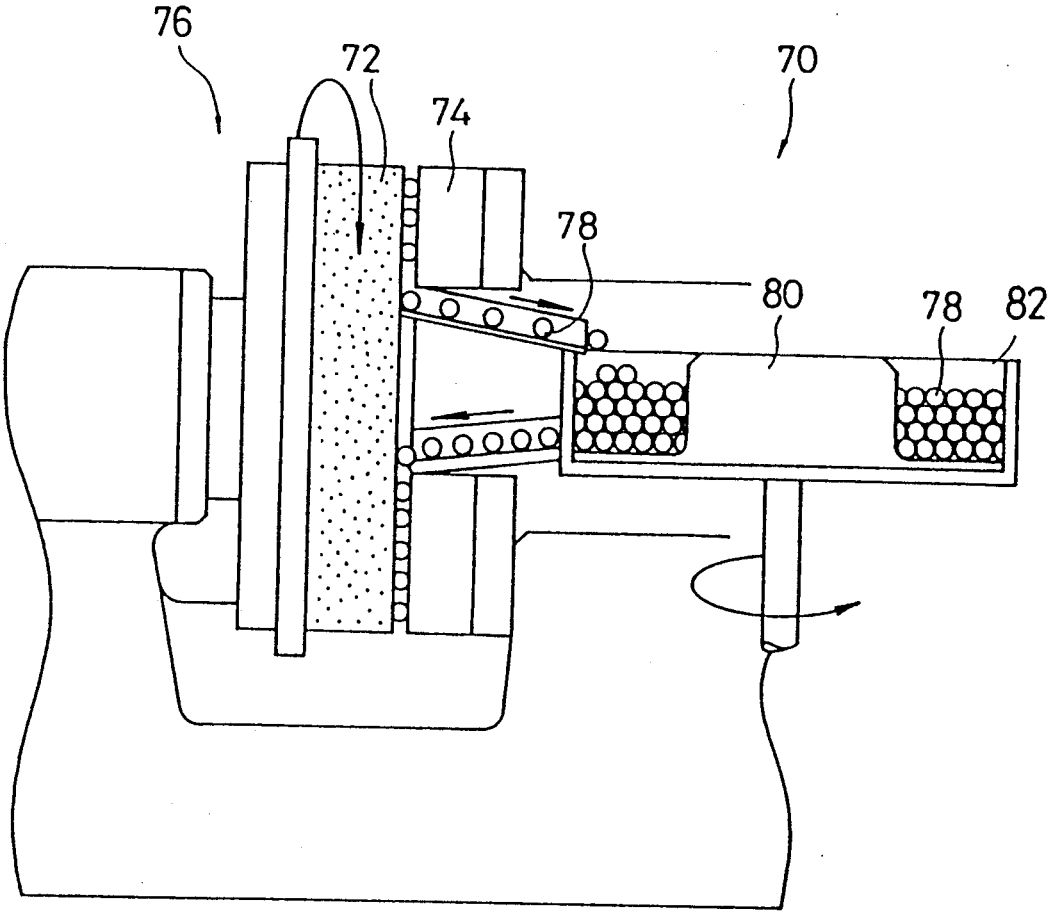
FIG. 7 PRIOR ART
FIG. 7 is a front view of a machining apparatus of prior art.

The overall steel ball machining apparatus 10 is shown in FIGS. 5 and 6. FIG. 5 is a front view and FIG. 6 is a top view. The apparatus 10 comprises a rotor type conveyor 18 having a steel ball storing vessel 20, and a machining mechanism 30. Steel balls 12 are fed successively from the vessel 20 to the machining mechanism 30.

The machining mechanism 30 comprises a pair of opposing machining plates, namely, rotary plate (disc) 32 and a stationary plate 34. The rotary plate 32 and the stationary plate 34 are made of special cast iron which is hardened by heat treatment. The respective opposing surfaces are formed with concentric ball grooves with the same pitch. The machining mechanism 30 further comprises a driving means to cause a relative motion between the rotary plate 32 and the stationary plate 34, namely, an electric motor 36, means for adjusting the distance between the rotary plate 32 and the stationary plate 34, pressing means (not shown), a conduit (not shown) for ejecting a grinding fluid between the rotary plate 32 and the stationary plate 34. The position of the rotary plate 32 may be adjusted according to the diameter of the processed balls and the plate 32 may be revolved by the motor 36 while being pressed toward the stationary plate 34.

Figure 1:
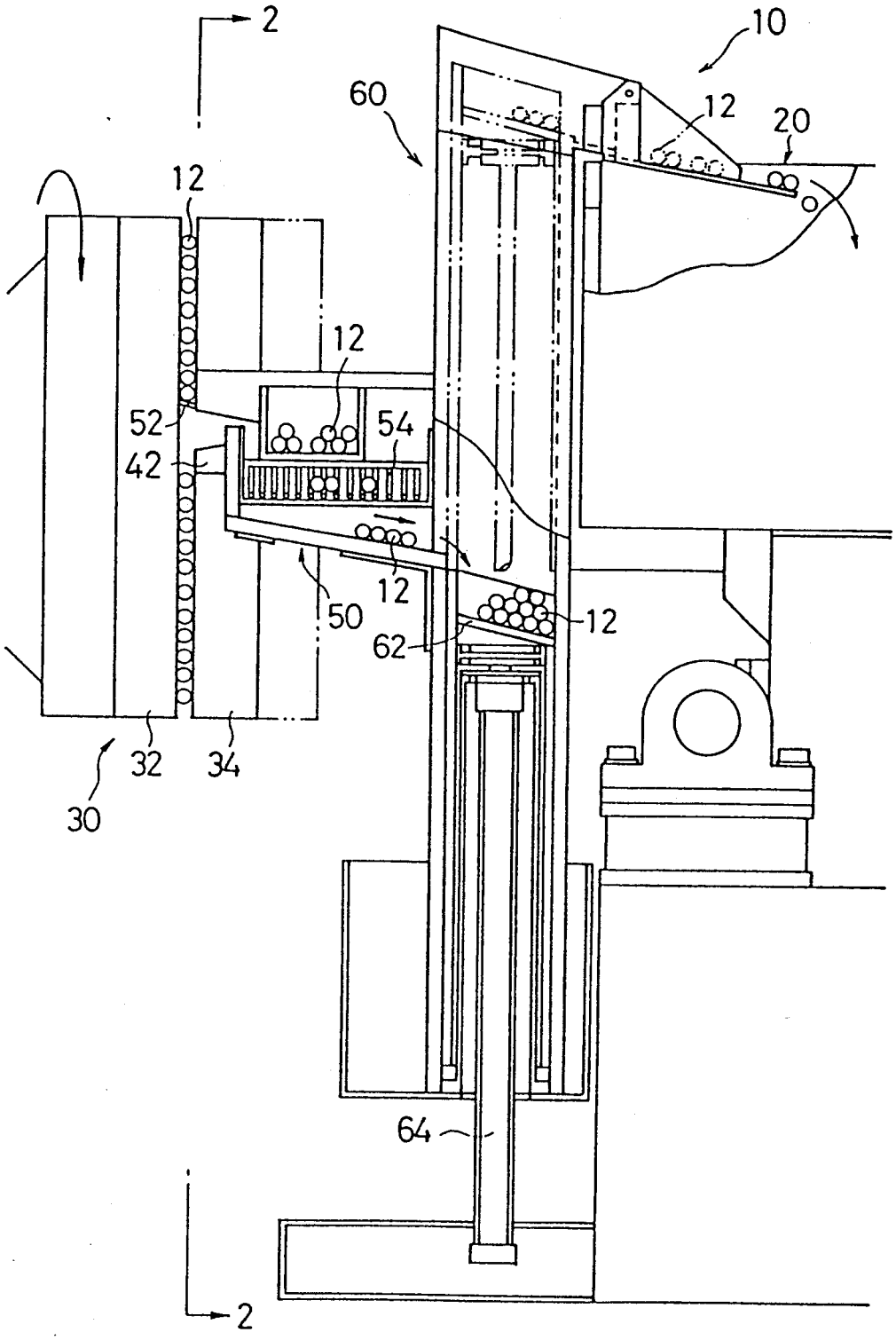
FIG. 1 is a front view partly in section of an embodiment of the steel ball machining apparatus in accordance with the present invention.
Figure 2:
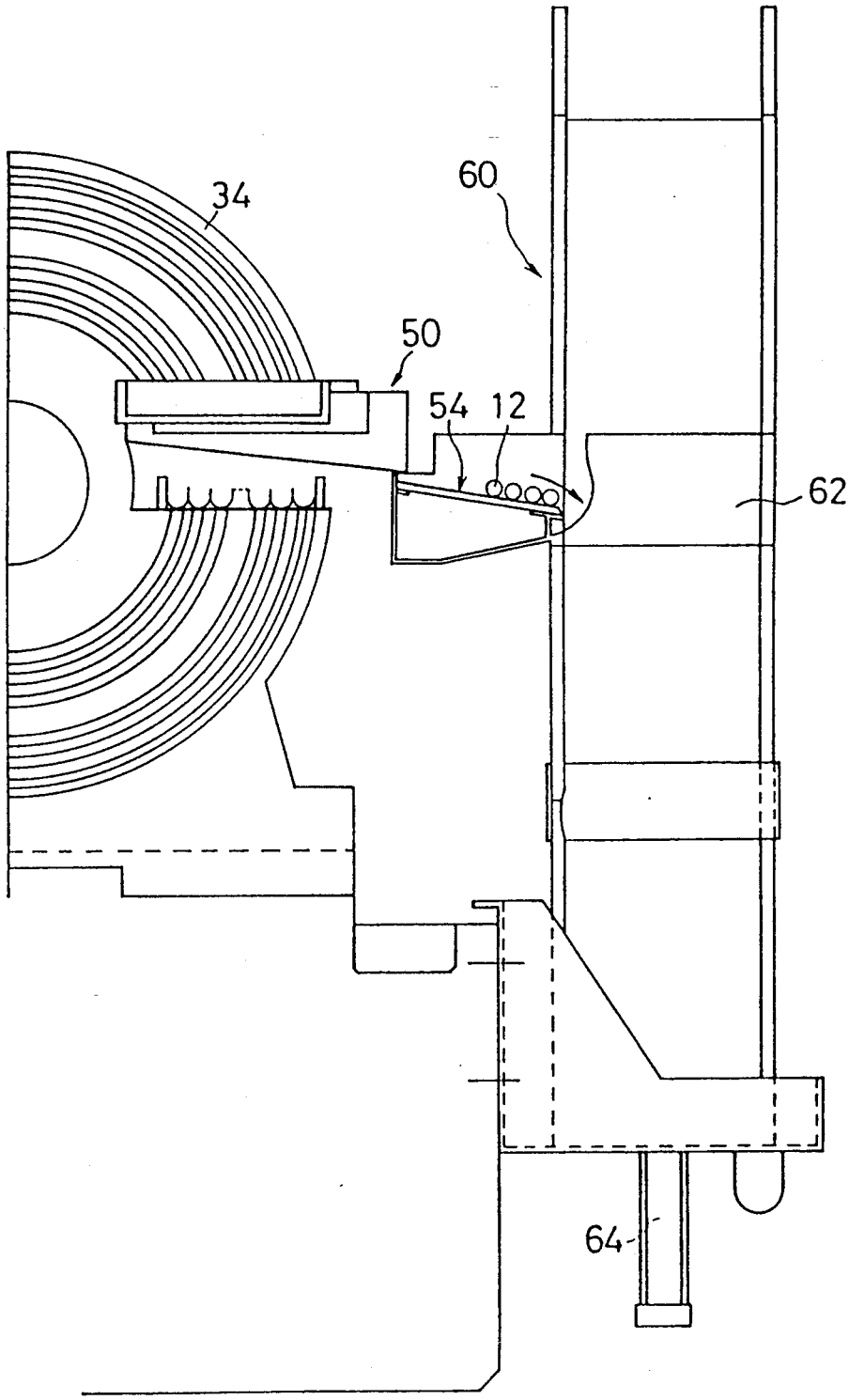
FIG. 2 is a section at line 2—2 in FIG. 1.
Figure 3:
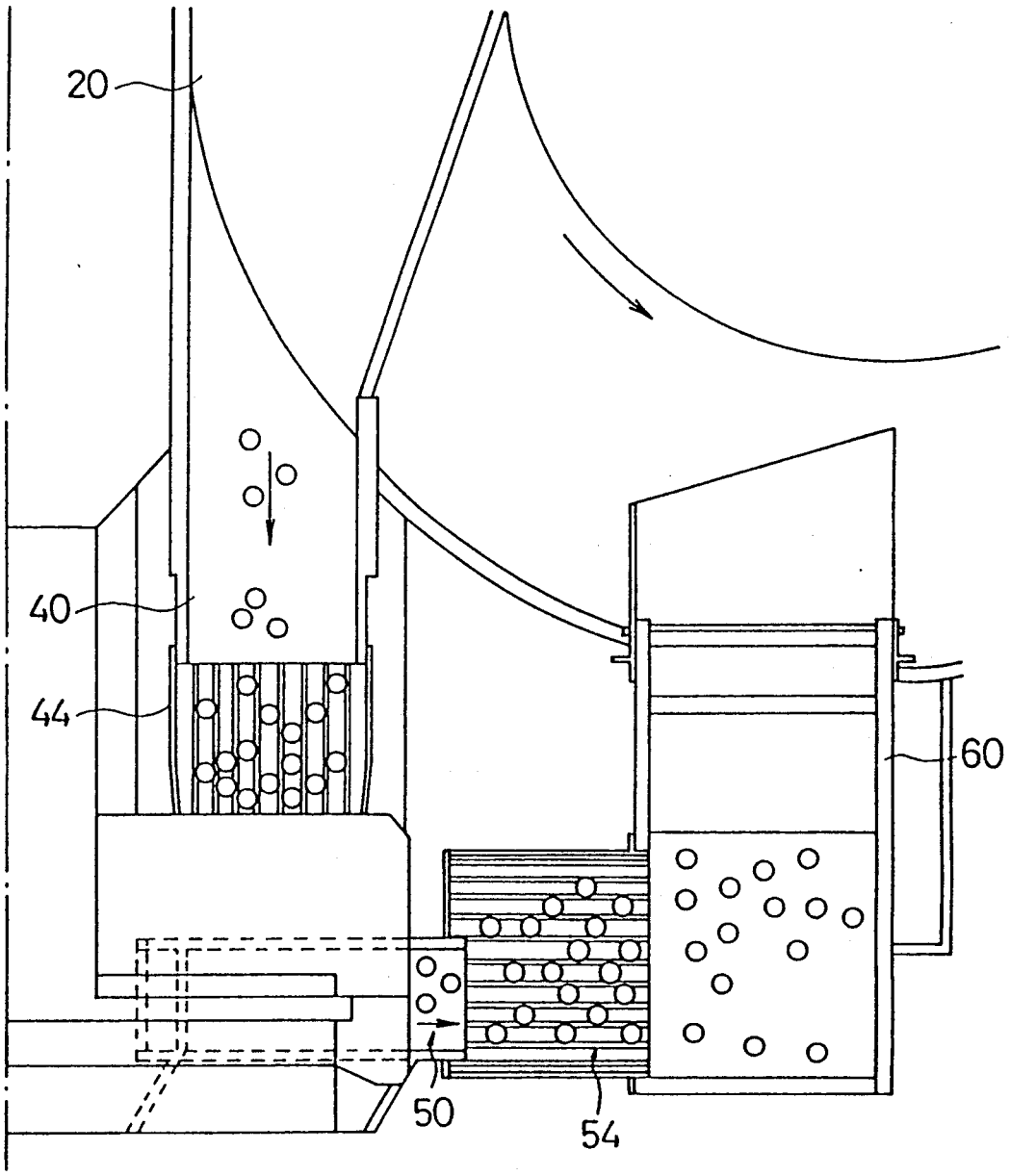
FIG. 3 is an enlarged top view of the ball supply path and discharge path in FIG. 1.

As shown in FIGS. 1 to 3, a ball supply path 40 to supply balls 12 from the vessel 20 to the machining mechanism 30 and a ball discharge path 50 to discharge balls 12 from tthe machining mechanism 30 to the vessel 20 are provided between the ball storing vessel 20 and the machining mechanism 30. The stationary plate 34 is recessed at one point os as to supply and discharge balls 12. The supply path 40 and the discharge path 50 are positioned at the recessed position.

A guide 42 is provided to the supply path 40 having the grooves with the same pitch as the ball grooves of the rotary plate 32 and the stationary plate 34 so as to guide the balls 12 into said grooves. Furthermore, a metallic pawl 52 (see FIG. 1) is provided to the discharge path 50 so as to guide the balls 12 out of the space between the rotary plate 32 and the stationary plate 34 into the discharge path 50.

A elevating conveyor 60 is to return the balls discharged from the machining mechanism 30 to the vessel 20. The elevating conveyor 60 is provided downstream of the discharge path 50 and comprises a ball receiving vessel 62 which may be raised or lowered by means of a pneumatic cylinder 64. The ball storing vessel 20 is positioned downstream of the elevating conveyor 60. The balls 12 raised in position by the elevating conveyor 60 are discharged to the vessel 20 at different radial positions thereof.

As mentioned above, the balls 12 are fed to the machining mechanism 30 from the vessel 20 through the supply path 40; and are returned to the vessel 20 from the machining mechanism 30 through the discharge path 50. As the balls 12 are circulated between the vessel 20 and the machining mechanism 30 several times, the balls 12 are finished so as to impart the desired dimensional accuracy thereto.

In the above embodiment, the function of the elevating conveyor 60 is to return the circulating steel balls 12 to the vessel 20 at the radially different positions of the vessel 20. Since the vessel 20 is adapted to send the balls 12 out to the supply path 40 as it rotates, the balls 12 fed to the machining mechanism 30 are polished by the different ball grooves, as the balls 12 are discharged to the vessel 20 at the radially different positions. Furthermore, the balls 12 are fully agitated until they reach the elevating conveyor 60 from the discharge path 50, and accordingly, the lot diameter variation (see JIS B 1501) may be minimized.

Figure 4:
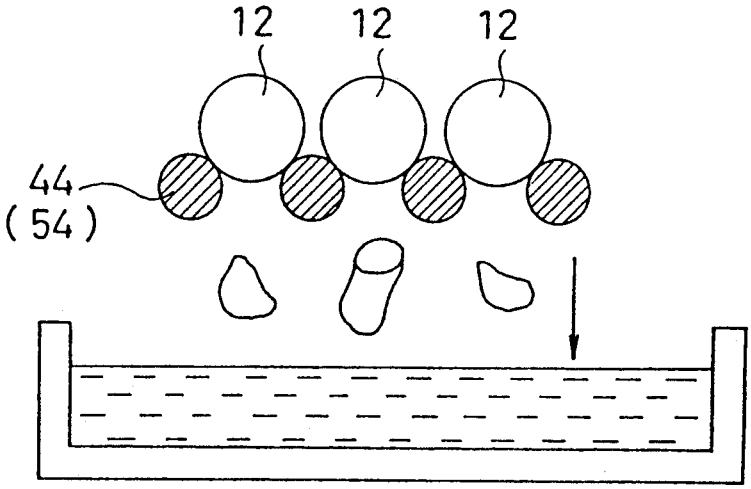
FIG. 4 is a section of a set of parallelly arranged bars used in the apparatus of the present invention.

In the above embodiment, sets of parallel bars 44, 54 are provided in the supply and discharge paths 40, 50. As shown in FIG. 4, the distances between the adjacent bars thereof are set slightly smaller than the diameter of the balls 12, and consequently, the foreign matter which is likely to mix with the steel balls 12, such as, wire materials, flashes or defective balls, will fall downwardly therefrom.

Now, operation of the apparatus 10 will be explained.

The steel balls 12 which are to be machined are first put into the storing vessel 20. The distance between the rotary plate 32 and the stationary plate is narrowed to be less than the diameter of the balls 12. Starting the conveyor 18, steel balls 12 are fed to the machining mechanism 30 through the supply path 40. The balls 12 will pass over the set of parallel bars 44 of the supply path 40 and are then guided along the grooves provided in the guide 42 and then come into contact with the ball grooves in the rotary plate 32. The operator will manually adjust the distance between the rotary plate 32 and the stationary plate so that the balls 12 may be properly held therebetween within the grooves.

The balls 12 are then introduced into the grooves formed in the rotary plate 32 and the stationary plate 34. The cover 38 shields the rotary plate 32 and the stationary plate. A grinding fluid ejects toward the ball grooves in the rotary plate 32 and the machining mechanism 30 is turned on. As the motor 36 starts, the rotary plate 32 starts to rotate relative to the stationary plate in a clockwise direction. The balls 12 make almost a round in the grooves and discharged to the discharge path 50 along with the fluid. The balls 12 will pass over the set of parallel bars 54 and are returned to the vessel 20 through the elevating conveyor 60 which functions intermittently. A number of steel balls 12 are continuously supplied from the vessel 20 and they are held between the rotary plate 32 and the stationary plate 34 under pressure. Until the desired dimensional accuracy is attained, the balls 12 will circulate between the machining mechanism 30 and the vessel 20. The rotations of the conveyor 18 and the plate 32 are adjusted so that a number of the balls 12 may be circulated under a well-balanced condition. The pressure between the rotary plate 32 and the stationary plate 34 are hydraulically controlled. The pressure is adapted to gradually increase from zero and are automatically controlled so that the energy consumption at the motor 36 may be maintained within the prescribed range.

As mentioned above, the steel balls 12 must pass over the set of parallel bars 44 (54) during the circulation, and therefore, in case of the supply path 40, accidentally mixed wire materials, defective balls, etc., may be separated from the balls 12 and prevented from entering the machining mechanism 30; and in case of the discharge path 50, flashes, etc., attached to the balls 12 may be separated therefrom and prevented from being returned to the vessel 20. Beneath the parallel bars 44 (54) is provided a pan and foreign matter, such as, flashes, may be retrieved into an oil tank along with the grinding fluid.

The above-described embodiment has been made with reference to a flashing process. Substantially the same apparatus is used in grinding and lapping processes as well. The differences reside in that the rotary plate is a grinding wheel having ball grooves and that the stationary plate is made of special cast iron which is not heat treated and that the pawl is made of plastics.

ADVANTAGES OF INVENTION

As a set of parallel bars is provided at least to one of the supply path or the discharge path of the steel balls in a ball machining apparatus used in flashing, grinding and lapping processes, foreign matter, such as, wire materials, defective balls, flashes and grinding wheel chips may be effectively removed in the supply to the machining mechanism and/or in the discharge of balls from the machining mechanism. Consequently, possible inroads of those materials into the machining mechanism along with the processed balls may be effectively prevented thereby avoiding damage to the ball grooves.

Especially, in the process prior to the process in which a grinding wheel is utilized, namely, in the flashing process, by removing foreign matter, the ball grooves in a grinding wheel may be protected, thereby enabling to produce steel balls with high quality with smaller size variations.

What is claimed is:

1. A steel ball machining apparatus comprising:

a machining mechanism having a pair of machining plates which are adapted to oppose and rotate relative to each other, the machining plates being spaced from each other by a distance such that they are able to effect machining of steel balls of a particular diameter;

a steel ball storing vessel for supplying to and receiving from said machining mechanism steel balls;

a steel ball supply path provided between said machining mechanism and said steel ball storing vessel;

a steel ball discharge path provided between said machining mechanism and said steel ball storing vessel adapted to discharge said steel balls to said vessel; and means for separating foreign matter from the balls and preventing foreign matter from being circulated with the balls to the machining mechanism, said separating means comprising a set of parallel bars provided in at least one of said steel ball supply path and steel ball discharge path, each of the parallel bars in said set being spaced from each adjacent parallel bar in the set by a distance slightly smaller than said diameter of the balls, whereby foreign matter associated with the machined balls will fall downwardly between the bars as the balls roll on the bars.

2. The steel ball machining apparatus according to claim 1 wherein said vessel is rotatable about an axis and adapted to send steel balls out to said supply path as said vessel rotates, characterized in that a elevating conveyor is provided between said discharge path and the vessel, and having means associated with said elevating conveyor for discharging the balls from said elevating conveyor into said vessel at radially different positions in the vessel relative to the axis of rotation of the vessel, as the elevating conveyor returns the balls to said vessel.

* * * * *